US007383602B2

(12) United States Patent
Tanaka et al.

(10) Patent No.: US 7,383,602 B2
(45) Date of Patent: Jun. 10, 2008

(54) DEVICE FOR HOLDING CLEANING WIPER AND CLEANING ARTICLE EMPLOYING HOLDING DEVICE

(75) Inventors: Yoshinori Tanaka, Kawaga (JP); Akemi Tsuchiya, Kagawa (JP)

(73) Assignee: Uni-Charm Corporation, Kawanoe-Shi, Ehime (JP)

( * ) Notice: Subject to any disclaimer, the term of this patent is extended or adjusted under 35 U.S.C. 154(b) by 336 days.

(21) Appl. No.: 10/480,855

(22) PCT Filed: Jun. 10, 2002

(86) PCT No.: PCT/JP02/05743

§ 371 (c)(1),
(2), (4) Date: Dec. 11, 2003

(87) PCT Pub. No.: WO02/102221

PCT Pub. Date: Dec. 27, 2002

(65) Prior Publication Data

US 2005/0005381 A1 Jan. 13, 2005

(30) Foreign Application Priority Data

Jun. 14, 2001 (JP) ..... 2001-180605

(51) Int. Cl.
*A47L 13/20* (2006.01)
*A47L 13/256* (2006.01)

(52) U.S. Cl. ..... 15/147.2; 15/210.1; 15/229.3

(58) Field of Classification Search ..... 15/228, 15/229.1, 229.2, 229.3, 229.7, 229.8, 145, 15/147.1, 147.2, 209.1, 210.1
See application file for complete search history.

(56) References Cited

U.S. PATENT DOCUMENTS 748,367 A 12/1903 Halght
1,437,145 A * 11/1922 Johnson ..... 15/210.1
1,437,245 A 11/1922 Hinchcliff
2,877,482 A 3/1959 Roy
3,495,918 A 2/1970 Leland
4,010,511 A * 3/1977 Komatsu ..... 15/104.94
4,827,556 A 5/1989 Corsetti
5,010,615 A 4/1991 Carter
6,047,435 A * 4/2000 Suzuki et al. ..... 15/229.8
6,079,075 A * 6/2000 Velez-Juan ..... 15/167.1

(Continued)

FOREIGN PATENT DOCUMENTS

CN 94201721.8 3/1995

(Continued)

OTHER PUBLICATIONS

Computer Generated English Translation of JP 08-336493.*
English Translation of JP 08-336493, Iwao Furuta, Dec. 24, 1996.*
Supplementary European Search Report dated Aug. 3, 2006 issued for corresponding European Patent Application No. EP02733446.

*Primary Examiner*—Laura C Guidotti
(74) *Attorney, Agent, or Firm*—Darby & Darby P.C.

(57) ABSTRACT

Disclosed is a device (2) for holding a cleaning wiper (1). The holding device includes: a synthetic resin body portion (10) bifurcated to have a pair of support plates (12) to be inserted into a tube (45) of the wiper; and a handle portion (30) extending from the body portion to be held by hand. Each support plate is in an elongated plate form having a width (W1) larger than a thickness (T1). The paired support plates extend parallel with each other to have inner side edges (12*b*) facing each other and outer side edges (12*a*) facing in opposite directions. Protrusions (15) having convexly curved edges are integrally formed on the respective outer side edges of the support plates. The paired support plates are elastically deformable to permit tip ends thereof to approach each other.

8 Claims, 7 Drawing Sheets

U.S. PATENT DOCUMENTS

| | | | | |
|---|---|---|---|---|
| 6,237,183 | B1 * | 5/2001 | Fischer | 15/167.1 |
| 6,813,801 | B2 | 11/2004 | Tanaka et al. | |
| 6,978,509 | B2 * | 12/2005 | Lin | 15/229.7 |
| 2004/0034956 | A1 * | 2/2004 | Tanaka et al. | 15/229.4 |
| 2005/0005381 | A1 | 1/2005 | Tanaka et al. | |
| 2005/0144749 | A1 * | 7/2005 | Yamada | 15/226 |

FOREIGN PATENT DOCUMENTS

| | | | |
|---|---|---|---|
| FR | 1148943 | | 12/1957 |
| FR | 1487987 | | 7/1967 |
| HU | 9403843 | | 8/1995 |
| HU | 9700252 | | 10/1997 |
| JP | 39-608 | | 1/1964 |
| JP | 39-6833 | | 3/1964 |
| JP | 39-20632 | | 7/1964 |
| JP | 40-18878 | | 7/1965 |
| JP | 41-14463 | | 7/1966 |
| JP | 41-14464 | | 7/1966 |
| JP | 49-69262 | | 7/1974 |
| JP | 58-194770 | A1 | 12/1983 |
| JP | 60-63157 | A1 | 5/1985 |
| JP | 60-63158 | A1 | 5/1985 |
| JP | 61-177575 | | 11/1986 |
| JP | 61-177576 | | 11/1986 |
| JP | 62-47351 | A1 | 3/1987 |
| JP | 62-184851 | | 11/1987 |
| JP | 63-26131 | Y2 | 7/1988 |
| JP | 63-121065 | | 8/1988 |
| JP | 1-66267 | U | 4/1989 |
| JP | 1-79454 | | 5/1989 |
| JP | 1-79455 | | 5/1989 |
| JP | 1-79456 | | 5/1989 |
| JP | 2-4541 | U | 1/1990 |
| JP | 5-95457 | | 12/1993 |
| JP | 6-337 | | 1/1994 |
| JP | 7-24257 | U | 5/1995 |
| JP | 08-336493 | | 12/1996 |
| JP | 3043196 | | 8/1997 |
| JP | 10-43116 | | 2/1998 |
| JP | 10-117985 | A | 5/1998 |
| JP | 10-225409 | | 8/1998 |
| JP | 10-328107 | A1 | 12/1998 |
| JP | 11-276402 | A | 10/1999 |
| JP | 2002-165742 | | 6/2002 |
| WO | WO 02/03847 | A2 * | 1/2002 |
| WO | 02102221 | | 12/2002 |

* cited by examiner

DEVICE FOR HOLDING CLEANING WIPER AND CLEANING ARTICLE EMPLOYING HOLDING DEVICE

BACKGROUND OF THE INVENTION

1. Field of the Invention

The present invention relates to a device for holding a disposable or reusable cleaning wiper, and also relates to a cleaning article composed of the holding device and the wiper.

2. Description of the Related Art

Devices for detachably holding wipers are disclosed in Japanese Unexamined Patent Publication No. H8-336493 (336493/1996) and Japanese Utility-Model Registration No. 3043196, for example.

In Japanese Unexamined Patent Publication No. H8-336493, there is disclosed a mop holder having a pair of ring-shaped support members, which are integrally formed with a handle. When the paired support members are inserted into a bag-shaped attachment portion formed in a mop, the ring-shaped support members are elastically deformed, so that the mop can be held by the mop holder.

In Japanese Utility-Model Registration No. 3043196, on the other hand, there is disclosed a cleaning device for holding a cleaning sheet. This cleaning device has arm portions curved to extend rearwardly. These arm portions are covered with the cleaning sheet.

In these prior arts, elastic deformation of the ring-shaped support members or the arm portions upon attachment of the mop or the cleaning sheet makes it possible to firmly hold the mop or the cleaning sheet.

However, in the mop holder disclosed in Japanese Unexamined Patent Publication No. H8-336493, when the ring-shaped support members are attached to the bag-shaped holding portion of the mop, the outer peripheral edges of the ring-shaped support members are brought into direct contact with the inner face of the bag-shaped holding portion to slide almost entirely along the inner face of the bag-shaped holding portion of the mop. At this time, due to the elastic repulsive force of the elastically deformed support members, the sliding resistance between the outer peripheral edges of the support members and the bag-shaped holding portion becomes very large. Therefore, it requires a large force to insert the support members into the bag-shaped holding portion of the mop till the end, thereby making it difficult to attach the mop holder to the mop.

This is also true for the cleaning device disclosed in Japanese Utility-Model Registration No. 3043196. When the arm portions are elastically deformed with the cleaning sheet to be put thereon, the cleaning sheet has to be slid over almost the entire outer peripheral edges of the arm portions for attachment. Therefore, the attachment requires a large force, thereby making it difficult to attach the arm portions to the cleaning sheet.

SUMMARY OF THE INVENTION

The present invention has been worked out in view of the shortcoming in the prior art set forth above. It is therefore an object of the present invention to provide a holding device utilizing elastic deformation thereof for reliably holding a wiper, in which a sliding resistance upon attachment of the wiper can be minimized for facilitating the attachment of the wiper, and a cleaning article employing the holding device.

According to a first aspect of the present invention, there is provided a device for holding a cleaning wiper, the holding device comprising: a synthetic resin body portion bifurcated to have a pair of support plates to be inserted into a tube of the wiper; and a handle portion extending from the body portion to be held by hand, each support plate being in an elongated plate form having a width larger than a thickness, the paired support plates extending parallel with each other to have inner side edges facing each other and outer side edges facing in opposite directions, protrusions having convexly curved edges being integrally formed on the respective outer side edges of the support plates, the paired support plates being elastically deformable to permit tip ends thereof to approach each other.

When the support plates of the holding device of the present invention are inserted into the tube of the wiper, the support plates are deformed, and then, the protrusions whose edges are convexly curved slide on the inner face of the tube. Therefore, although the protrusions are brought into contact with the inner face of the tube by an elastic repulsive force of the support plates, only the protrusions slide on the inner face of the tube, thereby reducing sliding resistance and facilitating attachment of the wiper.

For example, it is preferred that the support plate has a length of 70 to 170 mm, and a load required to bring the tip ends of the support plates into contact with each other is 2.4 to 7.4 N. With the length of the support plate and the load being set within the foregoing ranges, the support plates can be smoothly inserted into the tube.

It is also preferred that the protrusion comprises an elastically deformable rib defining a hollow in the protrusion. With such construction, the sliding resistance between the protrusions and the inner face of the tube can be reduced by deformation of the ribs upon insertion of the support plates into the tube.

Also preferably, the support plate is provided at a root portion thereof with a thick portion in which the thickness of the plate is increased. In this case, the tube of the wiper can be certainly held with the support plates by widening the end of the tube of the wiper with the thick portions.

It is also preferred that the body portion and the handle portion are detachably connected through a first coupling on the side closer to an upper surface of the body portion and a second coupling on the side closer to a lower surface of the body portion, and the second coupling uses a coupling configuration different from that of the first coupling, thereby eliminating the possibility of connecting the handle portion to the body portion upside down. With such construction, the body portion and the handle portion can be prevented from being assembled upside down by a user.

According to another aspect of the present invention, there is provided a cleaning article comprising: the holding device as set forth above; and the wiper to be attached to the holding device, the wiper having two tubes extending parallel with each other, each tube having an internal width larger than the width of the support plate of the holding device so that when the respective support plates are inserted into the tubes, the protrusions formed on the support plates slidingly move in the tubes, thereby deforming the support plates to approach each other.

In this case, it is preferred that narrow internal width portions, in which the internal width of the tube is reduced, are provided in intermediate positions of the respective two tubes of the wiper in a longitudinal direction thereof so that when the protrusions formed on the support plates pass the narrow internal width portions, the paired support plates are deformed to approach each other, and then, when the support plates are completely inserted and the protrusions come out of the narrow internal width portions, the paired support plates move away from each other, thereby holding the wiper to prevent detachment thereof from the holding device. With the narrow internal width portions being thus provided, the wiper can be certainly held by the holding device.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscurity of the present invention.

Figure 1:
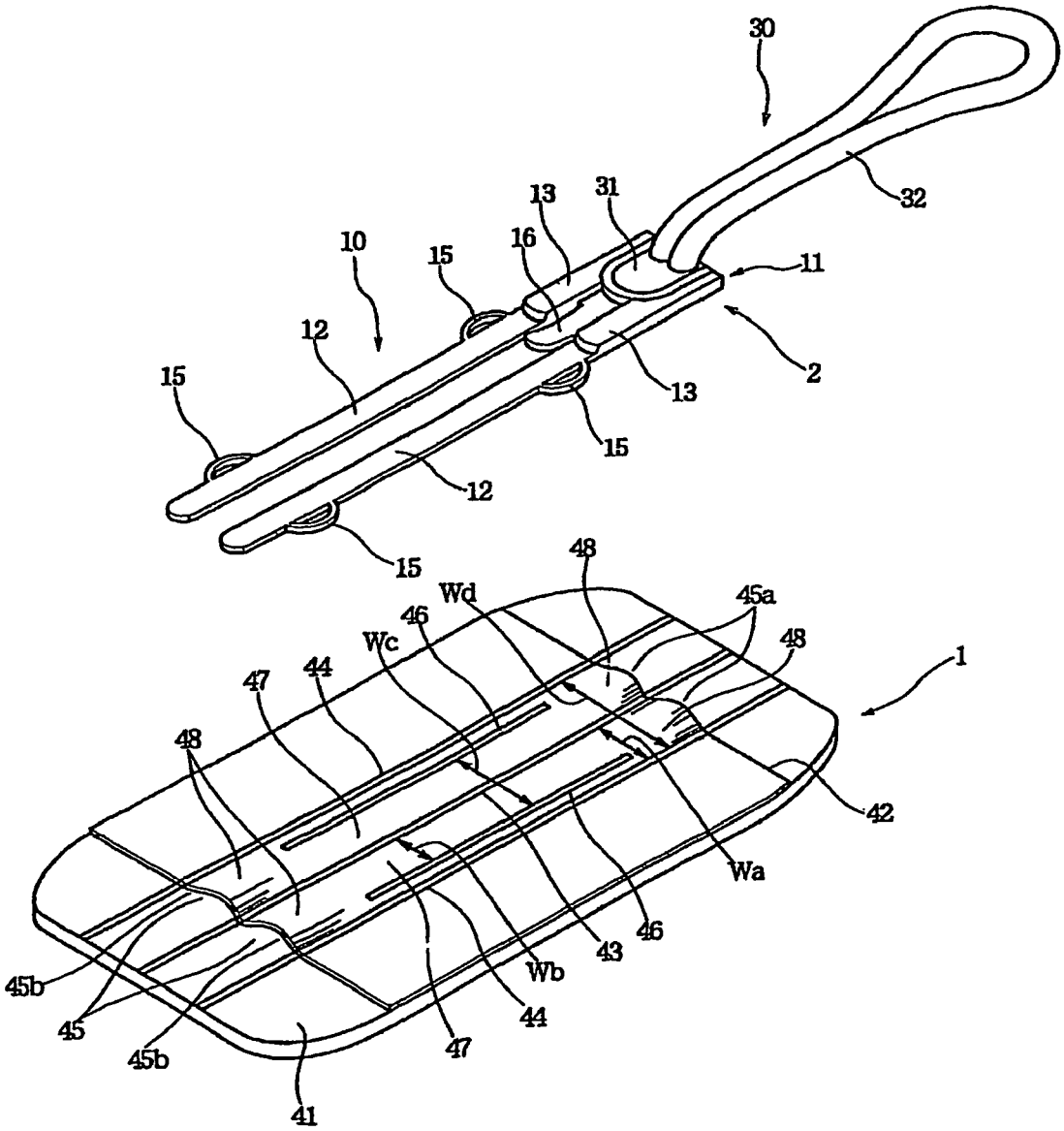
FIG. 1 is a perspective view showing a cleaning article comprising a holding device and a wiper according to one embodiment of the present invention.
Figure 2:
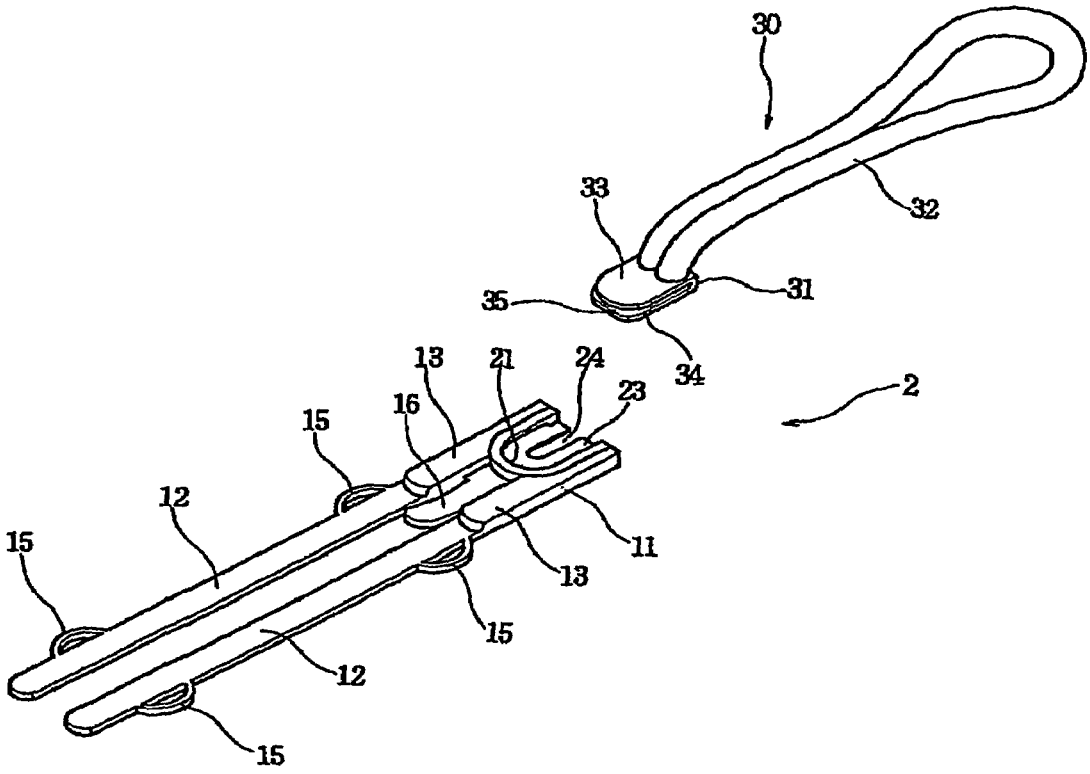
FIG. 2 is an exploded perspective view showing the holding device alone.
Figure 3A:
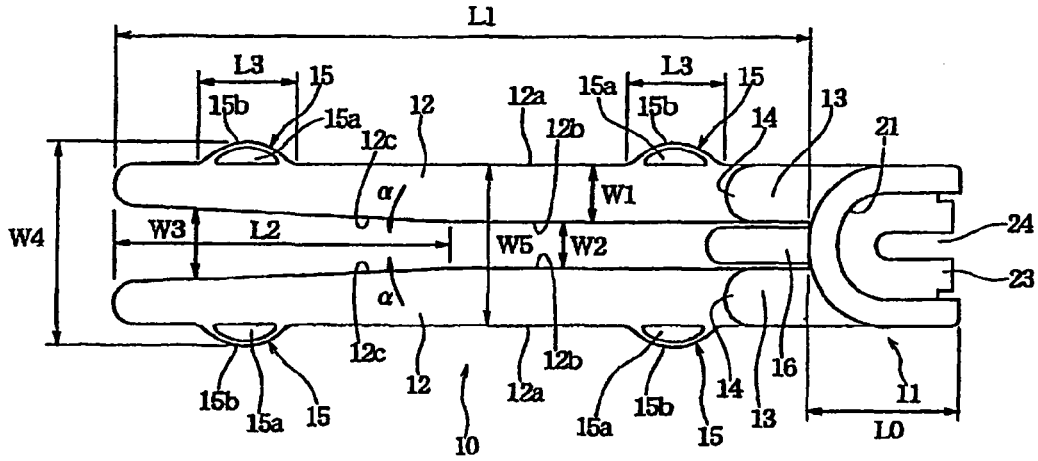
FIGS. 3A, 3B and 3C are a top plan view, a sectional view and a bottom plan view of a body portion of the holding device.
Figure 3B:
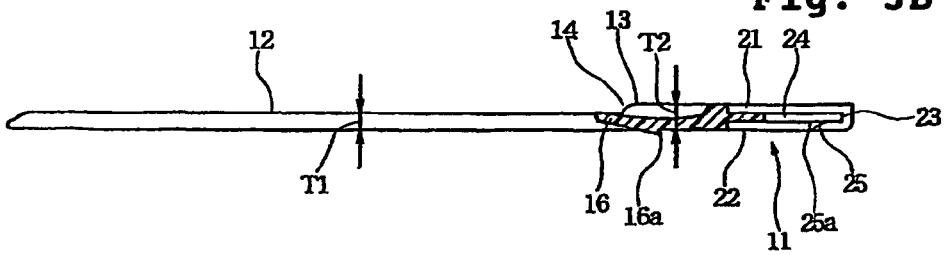
Figure 3C:
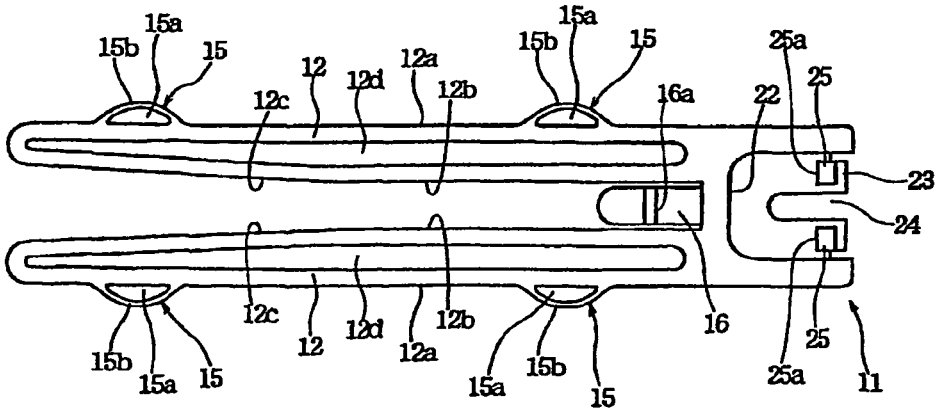
Figure 4A:
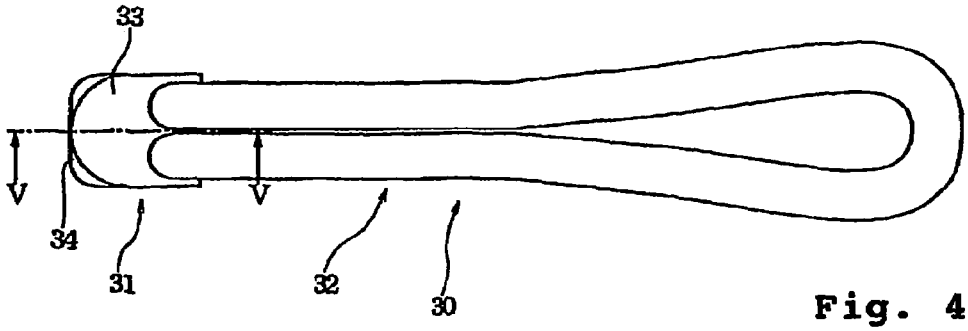
FIGS. 4A, 4B and 4C are a top plan view, a side view and a bottom plan view of a handle portion of the holding device.
Figure 4B:
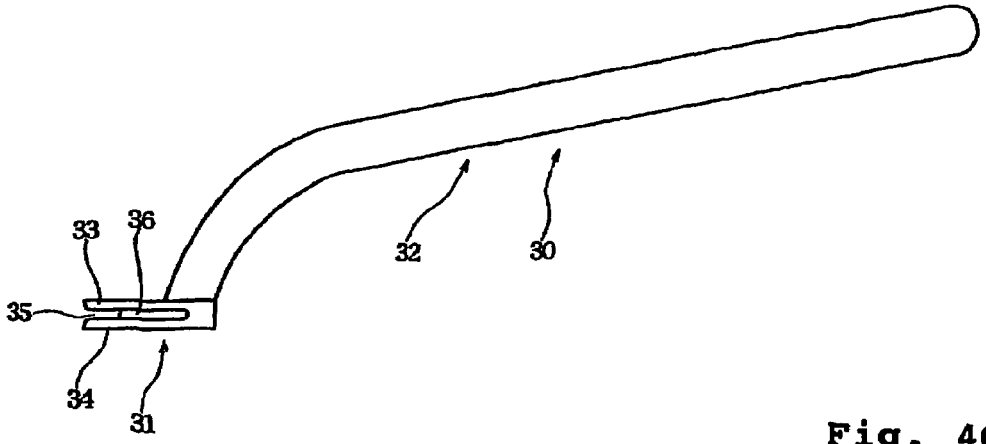
Figure 4C:
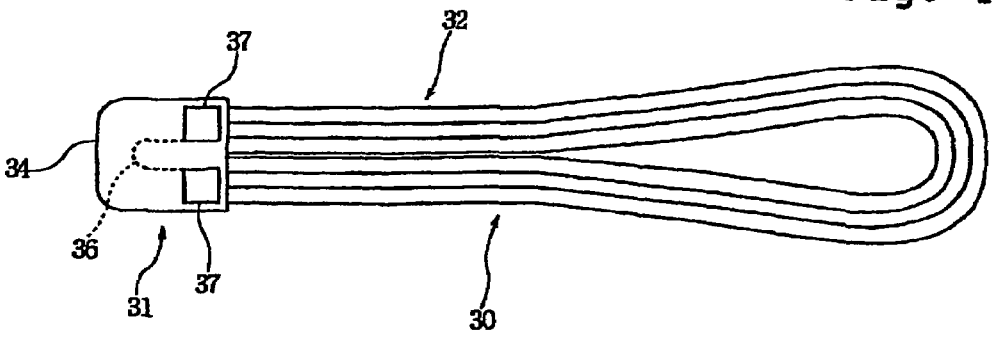
Figure 5:
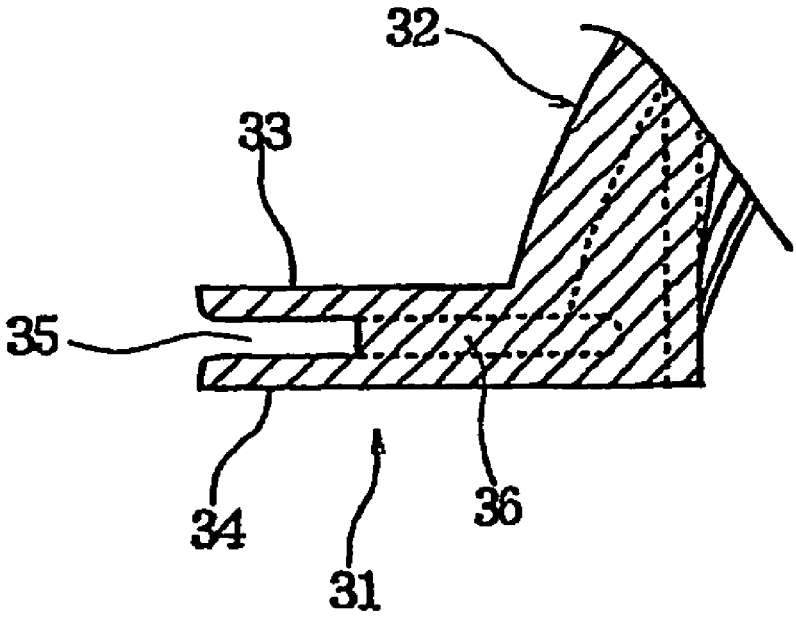
FIG. 5 is a sectional view showing a connecting portion of the handle portion, taken along line V-V of FIG. 4A.
Figure 6:
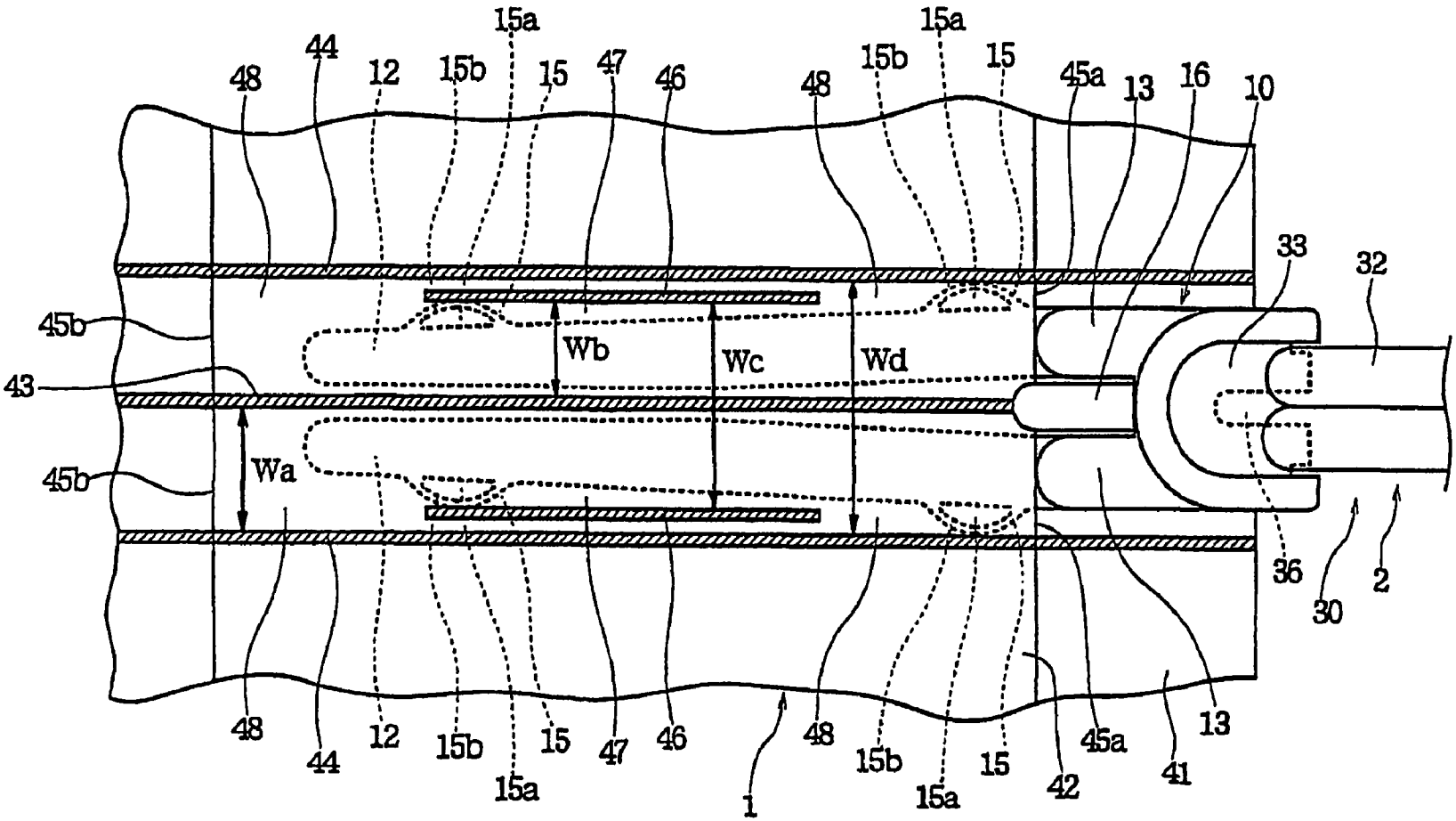
FIG. 6 illustrates a condition where the wiper is in the middle of attachment to the holding device.
Figure 7A:
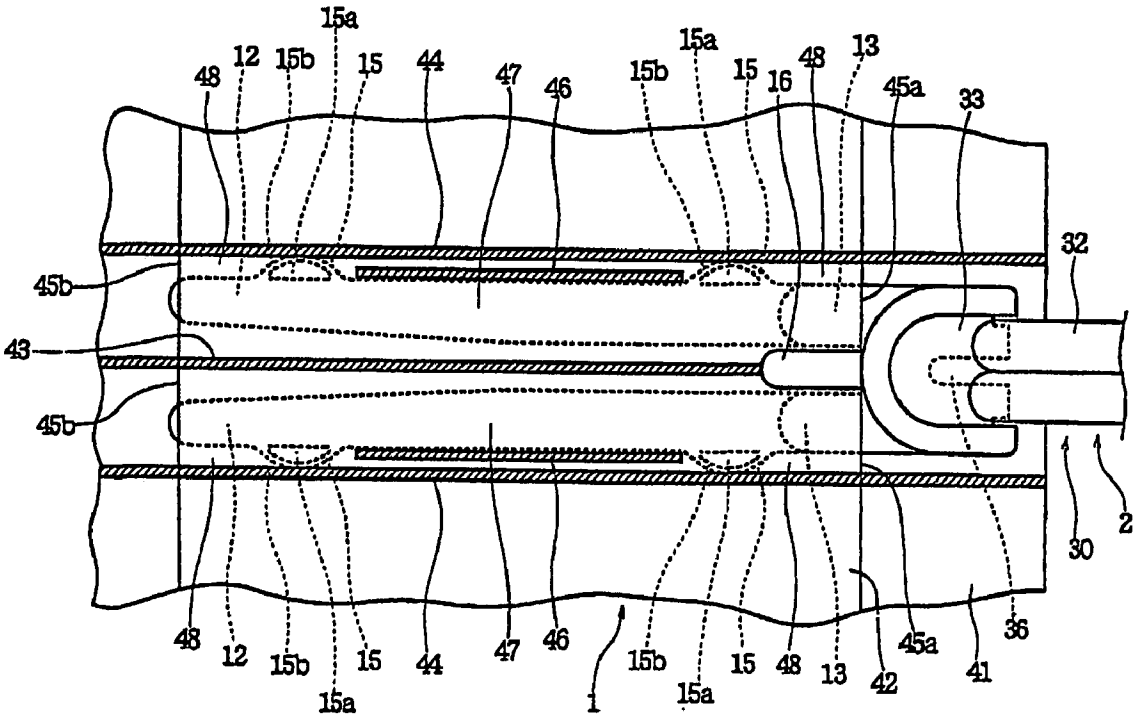
FIG. 7A illustrates a condition where the wiper is attached to the holding device.
Figure 7B:
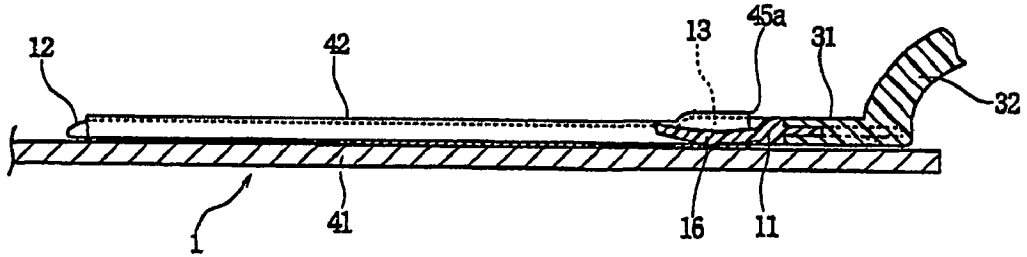
FIG. 7B is a sectional view of FIG. 7A.

FIG. 1 is a perspective view showing a cleaning article comprising a holding device and a wiper according to one embodiment of the present invention; FIG. 2 is an exploded perspective view showing the holding device alone; FIGS. 3A, 3B and 3C are a top plan view, a sectional view and a bottom plan view of a body portion of the holding device; FIGS. 4A, 4B and 4C are a top plan view, a side view and a bottom plan view of a handle portion of the holding device; FIG. 5 is a sectional view showing a connecting portion of the handle portion, taken along line V-V of FIG. 4A; FIG. 6 illustrates a condition where the wiper is in the middle of attachment to the holding device; and FIG. 7A illustrates a condition where the wiper is attached to the holding device, and FIG. 7B is a sectional view of FIG. 7A.

As shown in FIG. 1, the cleaning article is composed of a disposable wiper 1 and a holding device 2 to which the wiper 1 is to be attached. As shown in FIG. 2, the holding device 2 can be disassembled into a body portion 10 and a handle portion 30.

The individual body portion 10 and handle portion 30 are injection molded of polyolefin resin, such as polypropylene (PP).

As shown in FIG. 3A, the body portion 10 has a connecting portion 11 of a length L0 at its root portion, and bifurcated, forwardly of the connecting portion 11, to have a pair of support plates 12 and 12 of a length L1. Outer side edges 12*a* and 12*a* of the support plates 12 and 12 extend generally linearly and parallel with each other.

The individual support plates 12 and 12 have a constant width W1 over a predetermined length range, forwardly of the connecting portion 11, so that inner side edges 12*b* and 12*b* of the support plates 12 and 12 extend parallel with each other over the range. Therefore, the spacing W2 between the inner side edges 12*b* and 12*b* facing each other is constant. Over a range of length L2 at the tips of the support plates 12 and 12, the inner side edges of the support plates 12 and 12 are tapered (hereinafter, referred to as tapered side edges 12*c* and 12*c*). The tapered side edges 12*c* and 12*c* are formed such that the spacing W3 therebetween gradually increases as approaching the tip ends of the support plates 12 and 12. Therefore, over the range of the length L2, the width of the individual support plates 12 gradually decreases as approaching the tip end thereof.

As shown in FIG. 3B, the support plates 12 and 12 have a generally constant thickness T1 over a predetermined length range. Here, the support plates 12 and 12 have longitudinally elongated recesses 12*d* on their lower surfaces, as shown in FIG. 3C, but the thickness T1 refers to a thickness of the portions surrounding the recesses 12*d* of the support plates 12 and 12. The support plates 12 and 12 are formed at their root portions with thick portions 13 and 13, which have a thickness T2 larger than the thickness T1. The front ends 14 and 14 of the thick portions 13 and 13 are curved to gradually increase in thickness rearwardly. In the top plan view of FIG. 3A, the front ends 14 and 14 are arcuate or convexly curved.

On the respective outer side edges 12*a* and 12*a* of the support plates 12 and 12, there are formed protrusions 15 projecting outwardly. The protrusion 15 has a length L3. The protrusions 15 are disposed in two positions on the respective outer side edges 12*a* and 12*a* of the support plates 12 and 12. The peak to peak distance W4 between the protrusion 15 disposed on one support plate 12 and the protrusion 15 disposed on the other support plate 12 is larger than the distance W5 between the outer side edges 12*a* and 12*a*.

The edge of the protrusion 15 is convexly curved, and a hollow 15*a* is formed in the protrusion 15. The portion defining the hollow 15*a* is referred to as rib 15*b*. The rib 15*b* is elastically deformable in such a direction that the hollow 15*a* can decrease in volume.

Between the paired support plates 12 and 12, a holding plate 16 is integrally formed to extend from the connecting portion 11. As shown in FIG. 3B, the holding plate 16 is downwardly convexly curved, and integrally formed at its lower surface with an engaging protrusion 16*a* which will engage the wiper 1 when the body portion 10 moves rightward as seen in the drawing.

The connecting portion 11 of the body portion 10 has a first mating recess 21 on the side closer to the upper surface and a second mating recess 22 on the side closer to the lower surface. As seen from FIGS. 3A and 3C, the first and second mating recesses 21 and 22 are different in outline: the first mating recess 21 being of a generally round outline; the second mating recess 22 being of a generally rectangular outline.

Between the first and second mating recesses 21 and 22, a mating plate 23 is integrally formed. The mating plate 23 is formed with a recess 24. As shown in FIGS. 3B and 3C, moreover, a pair of retaining projections 25 and 25 are formed to project from the lower surface of the mating plate 23. These retaining projections 25 and 25 have edges 25*a* and 25*a* directed toward the support plates 12 and 12.

As shown in FIGS. 4A, 4B and 4C, for the handle portion 30, a connecting portion 31 and a handle 32 are integrally formed.

The connecting portion 31 has a first mating protrusion 33 on the side closer to the upper surface and a second mating protrusion 34 on the side closer to the lower surface. Between the first and second mating protrusions 33 and 34, there is left a clearance 35, except for a mating protrusion 36 integrally formed therebetween. As shown in FIG. 4C, moreover, the second mating protrusion 34 is formed with two retaining holes 37 and 37.

The outline of the first mating recess 21 of the body portion 10 and the outline of the first mating protrusion 33 of the handle portion 30 are identical to thereby form a first coupling. The outline of the second mating recess 22 of the body portion 10 and the outline of the second mating protrusion 34 of the handle portion 30 are identical to thereby form a second coupling. Thus, the second coupling uses a coupling configuration different from that of the first coupling For connecting the body portion 10 to the handle portion 30, the first mating protrusion 33 of the handle portion 30 is fitted in the first mating recess 21 of the body portion 10; and the second mating protrusion 34 of the handle portion 30 is fitted in the second mating recess 22 of the body portion 10. At this time, the mating plate 23 of the body portion 10 is inserted into the clearance 35 of the handle portion 30, and the mating protrusion 36 of the handle portion 30 is mated with the recess 24 of body portion 10. In addition, the retaining projections 25 provided on the lower surface of the mating plate 23 of the body portion 10 engage the retaining holes 37 and 37 formed in the second mating protrusion 34 of the handle portion 30. Thus, the body portion 10 and the handle portion 30 are firmly engaged.

The body portion 10 and the handle portion 30 thus connected can be forcibly separated by disengaging the coupling between the retaining projections 25, 25 and the retaining holes 37, 37.

It should be noted that even if a user tries to connect the body portion 10 and the handle portion 30 upside down, the second mating protrusion 34 of the handle portion 30 can not enter the first mating recess 21 of the body portion 10, thereby preventing the body portion 10 and the handle portion 30 from being connected upside down.

In the body portion 10, the support plates 12 and 12 are in the form of thin elongated plate, and elastically deformable in directions α so that the tapered side edges 12*c* and 12*c* may come into contact with each other. In order to make the support plates 12 and 12 deformable in the directions α to the extent that permits the tapered side edges 12*c* and 12*c* to come into contact with each other, it is preferred that the width W1 of the respective support plates 12 and 12 is in a range of 5 to 20 mm and the length L1 is in a range of 70 to 170 mm. It is also preferred that a load required to deform the support plates 12 and 12 in the directions α and bring the tapered side edges 12*c* and 12*c* into contact with each other, is from 2.4 to 7.4 N. Below the foregoing limit, the wiper 1 can not be firmly held with the support plates 12 and 12. In excess of the foregoing limit, it requires too much force to deform the support plates 12 and 12 in the directions a for attachment of the wiper 1, making it difficult to attach the wiper 1.

Here, the load can be measured using a measuring instrument such that the outer side edge 12*a* of one support plate 12 is supported by the measuring instrument, the outer side edge 12*a* of the other support plate 12 is pushed, and the scale of the measuring instrument is read when the tapered side edges 12*c* and 12*c* come into contact with each other.

The support plates 12 and 12 are also deformable to bend upwardly in the drawing of FIG. 3B. To this end, the thicknesses T1 and T2 are set smaller than the width W1. For example, it is preferred that the thickness T1 is of the order of 1 to 4 mm and the thickness T2 is of the order of T1+1 to 5 mm.

On the other hand, when a value measured using a measuring instrument such that the lower surfaces of the support plates 12 and 12 are supported on the measuring instrument over a range of one-half of the length L1 from the tip ends of the support plates 12 and 12 and then the rear end of the connecting portion 11 is lifted up by 25 mm from the surface of the measuring instrument, is taken as bending strength, the bending resistance preferably ranges between 3 and 15 N. Below the foregoing limit, the support plates 12 and 12 are too soft to certainly press the wiper 1 against an object to be cleaned by holding the handle 32. This results in decreasing the wiping effect due to the wiper 1. In excess of the foregoing limit, the support plates 12 and 12 are excessively hard and a reaction force of pressing against the object to be cleaned directly acts on the hand holding the handle 32, so that the wiping operation becomes difficult.

On the other hand, the length L3 of the protrusion 15 is about 8 to 25 mm. In addition, the protrusion 15 protrudes from the outer side edge 12*a* of the support plate 12 by about 3 to 10 mm. Moreover, the rib 15*b* of the protrusion 15 has a thickness of about 0.5 to 2 mm.

Next, the wiper 1 shown in FIGS. 1, 6 and 7 comprises a body portion 41, which is formed from a nonwoven fabric, a laminate of nonwoven fabrics, a foamed resin material, or any other suitable materials. On the upper face of the body portion 41, there is disposed a holding sheet 42.

The body portion 41 and the holding sheet 42 are joined to each other at a center fusion-bond line 43 extending longitudinally of the wiper 1 and a pair of side fusion-bond lines 44 and 44 which are spaced apart from the center fusion-bond line 43 by Wa sidewardly. Between the center fusion-bond line 43 and the respective side fusion-bond lines 44, 44, there are formed a pair of elongated tubes (holding spaces) 45 and 45.

The body portion 41 and the holding sheet 42 are further joined to each other at narrowing fusion-bond lines 46 and 46, which are located in intermediate positions of the tubes 45 and 45 in the longitudinal (lengthwise) direction thereof and between the side fusion-bond lines 44 and 44. In the positions where the narrowing fusion-bond lines 46 and 46 are provided, therefore, there are formed narrow internal width portions 47 and 47 having an internal width Wb between the center fusion-bond line 43 and the respective narrowing fusion-bond lines 46 and 46. In the front and rear portions outside of the narrow internal width portions 47 and 47, on the other hand, the tubes 45 and 45 provide wide internal width portions 48 and 48 having the internal width Wa. The tubes 45 and 45 have openings 45*a* and 45*b* at their front and rear ends.

Both the internal width Wb of the narrow internal width portions 47 and the internal width Wa of the wide internal width portions 48 are larger than the width W1 of the support plates 12 and 12 of the holding device 2. In addition, the distance Wd between the side fusion-bond lines 44 and 44 is larger than the distance W5 between the outer side edges 12*a* and 12*a* shown in FIG. 3A and substantially equal to or slightly smaller than the peak to peak distance W4 between the protrusions 15 and 15. Moreover, the distance Wc between the narrowing fusion-bond lines 46 and 46 is equal to or slightly larger than the distance W5 between the outer side edges 12*a* and 12*a* shown in FIG. 3A and sufficiently smaller than the peak to peak distance W4 between the protrusions 15 and 15.

In the embodiment shown in FIGS. 1 and 6, the narrowing fusion-bond lines 46 and 46 are provided between and separately from the side fusion-bond lines 44 and 44'. However, it is also possible to integrate the narrowing fusion-bond lines 46 and 46 with the side fusion-bond lines 4.4 and 44. That is, the line width of the side fusion-bond lines 44 and 44 may be increased toward the center fusion-bond line 43 in the narrow internal width portions 47 to provide the internal width Wb, while maintaining the internal width Wa between the center fusion-bond line 43 and the respective side fusion-bond lines 44 in the wide internal width portions 48.

FIG. 6 illustrates a condition where the wiper 1 is in the middle of attachment to the holding device 2.

The tip ends of the support plates 12 and 12 of the holding device 2 are inserted into the tubes 45 and 45 of the wiper 1 through the openings 45*a* (insertion through the openings 45*b* is also possible). As the protrusions 15 and 15 provided close to the tip ends of the support plates 12 and 12 enter the wide internal width portions 48 and 48 of the tubes 45 and 45, the support plates 12 and 12 are slightly deformed in the directions α, and the edges of the protrusions 15 and 15 slide along the inner sides of the side fusion-bond lines 44 and 44.

When the edges of the protrusions 15 and 15 are brought into contact with the ends of the narrowing fusion-bond lines 46 and 46, then, the force to insert the support plates 12 and 12 is converted into a force to deform the support plates 12 and 12 in the directions a due to the convexly curved shape of the protrusions 15 and 15. Therefore, the support plates 12 and 12 are largely deformed in the directions a to bring the edges of the protrusions 15 and 15 into contact with the inner sides of the narrowing fusion-bond lines 46 and 46. As the support plates 12 and 12 are inserted farther, then, the edges of the protrusions 15 and 15 slide along the inner sides of the narrowing fusion-bond lines 46 and 46 due to the elastic recovery force of the support plates 12 and 12 tending to move away from each other.

Thus, the edges of the protrusions 15 and 15 slide along the inner sides of the narrowing fusion-bond lines 46 and 46 while being pressed against them due to the elastic recovery force of the support plates 12 and 12. However, since the length L3 of the protrusions 15 and 15 is not large and the edges of the protrusions 15 and 15 are convexly curved, the sliding area between the edges of the protrusions 15, 15 and the inner sides of the narrowing fusion-bond lines 46, 46 is always small. In addition, since the support plates 12 and 12 are of the elongated plate form, the elastic repulsive force when the support plates 12 and 12 are deformed in the directions a is not very large. Accordingly, the sliding load between the edges of the protrusions 15, 15 and the narrowing fusion-bond lines 46, 46 is not heavy, so that it requires only a small force to insert the holding device 2 into the wiper 1 farther than the state shown in FIG. 6 to the end.

Here, it may possibly happen that although the support plates 12 and 12 are deformed to the maximum limit in the directions α for insertion into the narrow internal width portions 47 and 47, the peak to peak distance between the protrusions 15 and 15 is still slightly larger than the distance Wc between the narrowing fusion-bond lines 46 and 46. In this case, the ribs 15*b* and 15*b* of the protrusions 15 and 15 are deformed in directions to decrease the areas of the hollows 15*a* and 15*a*, thereby enabling the protrusions 15 and 15 to pass through the narrow internal width portions 47 and 47.

When the protrusions 15 and 15 provided close to the tip ends of the support plates 12 and 12 go beyond the narrowing fusion-bond lines 46 and 46 to complete the insertion of the holding device 2 into the wiper 1, as shown in FIG. 7A, the support plates 12 and 12 move away from each other due to the elastic recovery force of the support plates 12 and 12, so that the respective narrowing fusion-bond lines 46 and 46 are sandwiched between the two protrusions 15 and 15 of the respective support plates 12 and 12, thereby holding the wiper 1 so as not to detach from the holding device 2.

At this time, at the openings 45*a* and 45*a* of the tubes 45 and 45, the holding sheet 42 is placed below the holding plate 16 and firmly retained by the engaging protrusion 16*a* provided on the lower surface of the holding plate 16, as shown in FIG. 7B. In addition, the thick portions 13 and 13 of the body portion 10 of the holding device 2 enter the openings 45*a* and 45*a* of the tubes 45 and 45 to increase the pressure to the holding plate 16 and the holding sheet 42, thereby increasing the clamping force of the holding plate 16 against the holding sheet 42. Thus, the wiper 1 can be certainly held by the holding device 2, preventing undesirable separation of the wiper 1 from the holding device 2 during wiping operation.

On the other hand, when the wiper 1 is detached from the holding device 2, the protrusions 15 and 15 provided close to the tip ends of the support plates 12 and 12 of the holding device 2 slide into the space between the narrowing fusion-bond lines 46 and 46, and the support plates 12 and 12 are deformed in the directions α, as shown in FIG. 6. At this time, too, since the edges of the protrusions 15 and 15 are convexly curved, the protrusions 15 and 15 can enter the space between the narrowing fusion-bond lines 46 and 46 smoothly. Therefore, the wiper 1 can be easily detached from the holding device 2.

As another embodiment of the present invention, it is also possible that the holding device 2 has a single support plate, two protrusions 15 and 15, which are shown in the embodiment of FIG. 1 and so on, are formed on each side edge of the single support plate, and the protrusions 15 are constructed to have a hollow 15*a* and a rib 15*b*. In this case, the wiper 1 is provided with a single tube. When the support plate is inserted into the tube, the ribs are elastically deformed so that the support plate may pass through the narrow internal width portion. When the support plate is completely inserted into the tube, on the other hand, the ribs are elastically recovered in the wide internal width portion to hold the wiper.

According to the present invention, as has been described above, the holding device can be smoothly attached to the wiper and the wiper can be certainly held by the holding device.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

The invention claimed is:

1. A cleaning article, comprising:

a holding device comprising:

a synthetic resin first body portion bifurcated to have a pair of support plates; each support plate being in an elongated plate form having a width larger than a thickness, the pair of support plates extending parallel with each other to have inner side edges facing each other and outer side edges facing in opposite directions, protrusions having convexly curved edges being integrally formed on the respective outer side edges of the support plates, the pair of support plates being elastically deformable to permit tip ends thereof to approach each other, and a handle portion extending from the first body portion to be held by hand; and a wiper attached to the holding device, said wiper having two tubes extending parallel with each other, each tube having an internal width larger than the width of the support plate of the holding device so that when the respective support plates are inserted into the tubes, the protrusions formed on the support plates slidingly move in the tubes to thereby deform the support plates and cause them to approach each other, said wiper comprising a second body portion and a holding sheet joined to the second body portion at a center fusion-bond line extending longitudinally with respect to said wiper and a pair of side fusion-bond lines which are laterally spaced apart from the center fusion-bond line so that the two tubes are respectively formed each between the center fusion-bond line and one of the side fusion-bond lines, wherein the holding sheet of the wiper is shorter in length than the second body portion, each tube is defined by the holding sheet which is centered on the second body portion to have two openings into which one of the tip ends of the support plates is inserted, the two openings located at each of two ends of the holding sheet longitudinally opposite to each other, and the two openings of each tube are defined by the two ends of the holding sheet that are spaced inward from corresponding ends of the second body portion.

2. The cleaning article as set forth in claim 1, wherein the support plate has a length of 70 to 170 mm, and a load required to bring the tip ends of the support plates into contact with each other is 2.4 to 7.4 N.

3. The cleaning article as set forth in claim 1, wherein the protrusion comprises an elastically deformable rib defining a hollow in the protrusion.

4. The cleaning article as set forth in claim 1, wherein the support plate is provided at a root portion thereof with a thick portion in which the thickness of the plate is increased.

5. The cleaning article as set forth in claim 1, wherein a plurality of the protrusions are formed on each of the respective outer side edges of the support plates.

6. The cleaning article as set forth in claim 1, wherein the first body portion and the handle portion are detachably connected through a first coupling on the side closer to an upper surface of the first body portion and a second coupling on the side closer to a lower surface of the first body portion, the second coupling using a coupling configuration different from that of the first coupling, thereby eliminating the possibility of connecting the handle portion to the first body portion upside down.

7. The cleaning article as set forth in claim 1, wherein narrow internal width portions, in which the internal widths of the tubes are reduced, are provided in intermediate portions of the respective two tubes of the wiper in a longitudinal direction thereof so that when the protrusions formed on the support plates pass the narrow internal width portions, the pair of support plates are deformed to approach each other, and then when the support plates are completely inserted and the protrusions come out of the narrow internal width portions, the pair of support plates move away from each other to thereby hold the wiper to prevent detachment thereof from the holding device.

8. The cleaning article as set forth in claim 7, further comprising:

a pair of narrowing fusion-bond lines extending longitudinally with respect to said wiper which are each laterally spaced apart from the center fusion-bond line, each between the center fusion-bond line and one of the pair of side fusion bond lines so that said narrow internal width portions of the tubes are respectively formed each between the center fusion-bond line and one of the narrowing fusion-bond lines.

* * * * *